US012251022B2

(12) United States Patent
Odom

(10) Patent No.: US 12,251,022 B2
(45) Date of Patent: Mar. 18, 2025

(54) FENCE SEAT DEVICE

(71) Applicant: Sharon Odom, Greensboro, NC (US)

(72) Inventor: Sharon Odom, Greensboro, NC (US)

( * ) Notice: Subject to any disclaimer, the term of this patent is extended or adjusted under 35 U.S.C. 154(b) by 137 days.

(21) Appl. No.: 18/185,658

(22) Filed: Mar. 17, 2023

(65) Prior Publication Data

US 2023/0371691 A1 Nov. 23, 2023

Related U.S. Application Data

(60) Provisional application No. 63/343,700, filed on May 19, 2022.

(51) Int. Cl.
*A47C 1/121* (2006.01)
*A47C 4/04* (2006.01)
*A47C 9/06* (2006.01)

(52) U.S. Cl.
CPC ..... *A47C 1/121* (2013.01); *A47C 4/04* (2013.01); *A47C 9/06* (2013.01)

(58) Field of Classification Search
CPC ..... A47C 9/06; A47C 1/121; A47C 4/04
USPC ..... 297/14, 255
See application file for complete search history.

(56) References Cited

U.S. PATENT DOCUMENTS 1,299,827 A * 4/1919 Edwards ..... B60N 2/286 297/255 X
1,412,367 A * 4/1922 Noack ..... B64D 11/0691 297/14
2,333,734 A * 11/1943 Nieltopp ..... A47C 9/06 297/188.01 X
2,508,822 A * 5/1950 Goldberg ..... A47D 1/103 297/255 X
2,858,056 A * 10/1958 Ownby ..... A47C 9/06 182/95
3,146,026 A * 8/1964 Berlin ..... A47D 1/103 297/255 X
4,718,717 A * 1/1988 Cruz ..... A47D 1/0085 297/331
5,123,377 A * 6/1992 Edwards ..... A01K 1/0272 119/28.5
5,185,892 A * 2/1993 Mitchell ..... A47K 3/122 297/14
5,310,242 A * 5/1994 Golder ..... A47D 1/10 297/14
5,590,427 A * 1/1997 Weterings ..... A47C 9/06 4/578.1
6,042,178 A * 3/2000 Hetherington ..... A47K 3/282 297/14
6,089,651 A * 7/2000 Carmen ..... A47C 4/20 297/14
6,224,153 B1 5/2001 Vodinh
(Continued)

FOREIGN PATENT DOCUMENTS

DE 202006020691 U1 * 8/2009 ..... A47C 5/06
GB 2575465 A * 1/2020 ..... A47C 9/06

*Primary Examiner* — Rodney B White
(74) *Attorney, Agent, or Firm* — Brennan, Manna & Diamond, LLC

(57) ABSTRACT

A fence seat device comprised of a base with at least one track that attaches to a fence and a seat with at least one leg. The device forms a generally chair-like structure that attaches to a fence and can be folded down from the fence and sat on when used in a position facing away from the fence. When not in use, the device can fold upwards onto the fence and locked into said position.

13 Claims, 5 Drawing Sheets

(56) References Cited

U.S. PATENT DOCUMENTS

| | | | | |
|---|---|---|---|---|
| 6,305,741 | B1 * | 10/2001 | Fernandez | A47C 9/06 297/14 |
| 6,343,834 | B1 * | 2/2002 | Wurmlinger | A47C 9/06 297/14 |
| 6,729,685 | B1 * | 5/2004 | Ebalobor | A47C 9/06 297/14 |
| 7,118,172 | B1 * | 10/2006 | Pattison-Sheets | A47C 4/52 297/129 X |
| 7,267,403 | B2 | 9/2007 | Conner | |
| 7,819,467 | B1 * | 10/2010 | Schimmeyer | A47C 4/48 297/14 |
| 8,251,455 | B1 | 8/2012 | Midkiff | |
| 8,287,042 | B1 * | 10/2012 | Schimmeyer | A47D 1/10 297/256.17 X |
| 9,474,380 | B2 * | 10/2016 | Chlapaty | A47C 15/004 |
| 11,234,522 | B1 * | 2/2022 | Marvin | A47C 3/16 |
| 2005/0200176 | A1 | 9/2005 | Conner | |
| 2008/0106130 | A1 | 5/2008 | Carpenter | |
| 2010/0304632 | A1 * | 12/2010 | De Meulemeester | B32B 5/26 428/221 |
| 2012/0098307 | A1 * | 4/2012 | Whittington | A47C 9/06 297/217.7 |
| 2013/0106154 | A1 * | 5/2013 | Buie | A47C 9/06 297/217.1 |
| 2024/0074583 | A1 * | 3/2024 | Wolf | A47C 9/06 |

* cited by examiner

FENCE SEAT DEVICE

CROSS-REFERENCE TO RELATED APPLICATION

The present application claims priority to, and the benefit of, U.S. Provisional Application No. 63/343,700, which was filed on May 19, 2022, and is incorporated herein by reference in its entirety.

FIELD OF THE INVENTION

The present invention relates generally to the field of chairs. More specifically, the present invention relates to a fence seat device comprised of a base with at least one track that attaches to a fence and a seat with at least one leg. The device forms a generally chair-like structure that attaches to a fence and can be folded down from the fence and sat on when used in a position facing away from the fence. When not in use, the device can be folded upwards onto the fence and locked into said position. Accordingly, the present disclosure makes specific reference thereto. Nonetheless, it is to be appreciated that aspects of the present invention are also equally applicable to other like applications, devices, and methods of manufacture.

BACKGROUND

Individuals who attend outdoor sporting events may need to bring portable chairs to sit comfortably while watching the event. Further, multiple chairs may be needed to accommodate a family, and transporting these chairs can be difficult and frustrating. In addition, constantly setting up, taking down, and transporting chairs can take up too much time and can take away time that could be spent enjoying the sporting event.

Therefore, there exists a long-felt need in the art for an improved seating device. There also exists a long-felt need in the art for a fence seat device that can be secured to a fence and can remain secured such that a user need not bring their own chair to a sporting event. Further, there exists a long-felt need in the art for a fence seat device that can be stored on a fence when not in use.

The subject matter disclosed and claimed herein, in one embodiment thereof, comprises a fence seat device. The device is comprised of a base with at least one track that attaches to a fence and a seat with at least one leg. The device forms a generally chair-like structure that attaches to a fence (preferably a chain link fence). The device can be folded down from the fence and sat on when used in a position facing away from the fence. When not in use, the device can fold upwards onto the fence and locked into said position. In a second embodiment, the device is comprised of a seat that allows a user to sit between (i.e., facing) the seat and a fence.

In this manner, the fence seat device of the present invention accomplishes all of the foregoing objectives and provides an improved seating device. The device can be secured to a fence and can remain secured such that a user need not bring their own chair to a sporting event. Further, the device can be folded and stored on a fence when not in use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a fence seat device. In the preferred embodiment, the device is comprised of a base with at least one track that attaches to a fence and a seat with at least one leg. In said preferred (first) embodiment, the device is comprised of a base that can be fixedly or removably attached to a fence (wherein the fence is preferably a chain link fence) with at least one fastener located on the base. The fastener allows the device to be suspended from the fence during use and while stored, such that the device can remain on the fence while not in use and need not to be transported.

The front surface of the base is comprised of a padding that functions as the backrest of the generally chair-like shape formed by the device in the preferred embodiment. The base is further comprised of at least one track. In the preferred embodiment, the base has two parallel tracks on the left and right edges of the base which allow the first arm to move up/down on the track to allow the device to fold/deploy. A first folding arm is preferably attached to the track via at least one hinge point. The first folding arm is then attached to the second folding arm via at least one hinge point. The second folding arm further attaches to the seat via at least one hinge point. The seat attaches to the base via at least one hinge.

The bottom surface of the seat is further comprised of at least one leg assembly comprised of an outer body and at least one inner body positioned within the outer body. The inner body is further comprised of at least one foot that contacts a ground surface. In one embodiment, the inner body is telescopic (and can be locked at a certain length via at least one locking mechanism) such that the length of the leg can be lengthened or shortened as necessary to accommodate the base being secured to a fence at differing heights. The leg contacts the ground and provides additional stability to the seat.

In a second embodiment, the base has no padding (backrest). The second arm also attaches to a secondary anchor point. The anchor point is comprised of at least one fastener that further secures the device to a fence (preferably a chain link fence) during use. In contrast to the first embodiment, the second embodiment allows a user to look through a fence instead of looking away from a fence.

Accordingly, the fence seat device of the present invention is particularly advantageous as it provides an improved seating device that can be secured to a fence and can remain secured, such that a user need not bring their own chair to a sporting event. Further, the device can be stored on a fence when not in use. In this manner, the fence seat device overcomes the limitations of existing methods of seating at sporting events known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
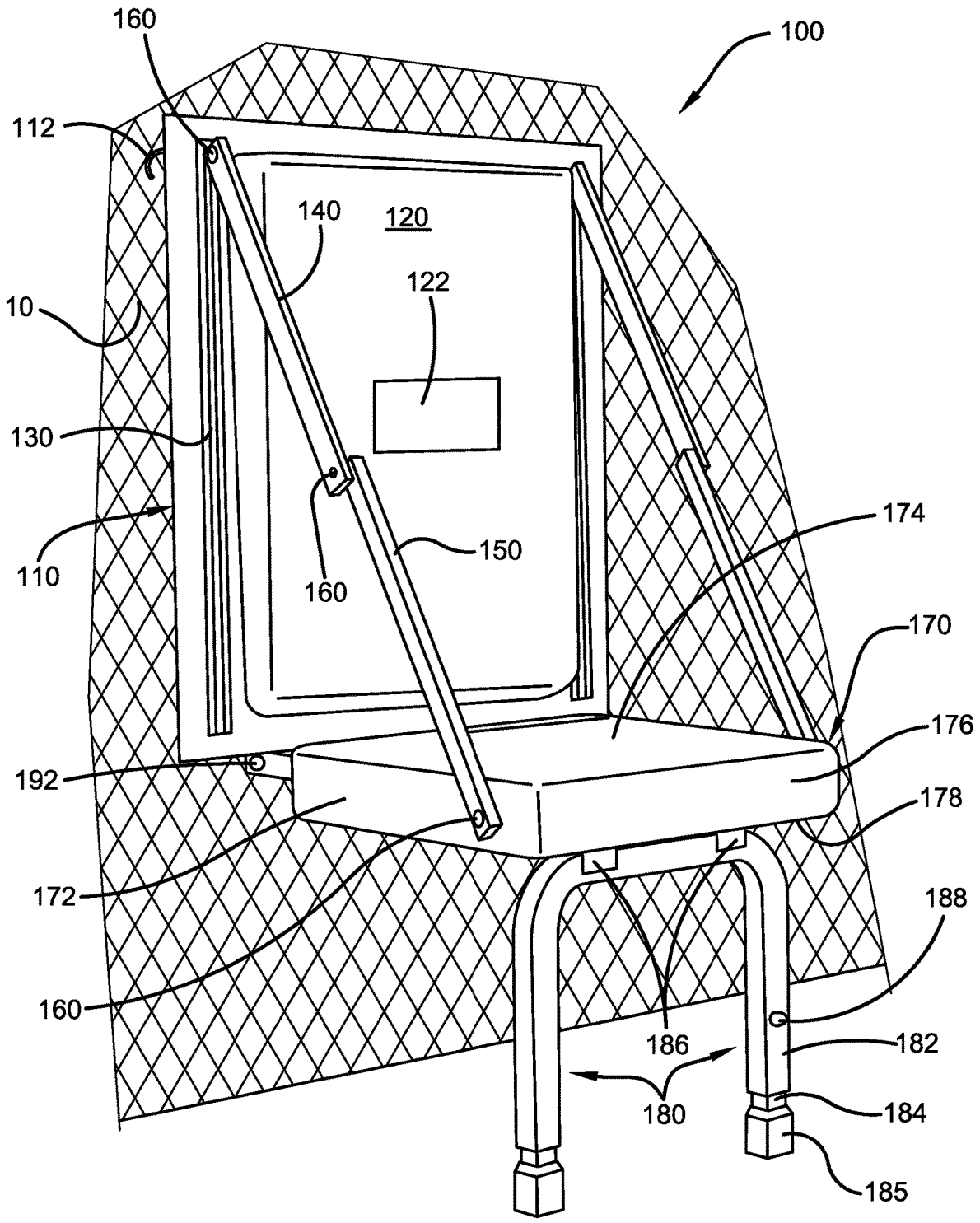
FIG. 1 illustrates a perspective view of a first potential embodiment of a fence seat device of the present invention while attached to a fence and deployed in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved seating device. There also exists a long-felt need in the art for a fence seat device that can be secured to a fence and can remain secured, such that a user need not bring their own chair to a sporting event. Further, there exists a long-felt need in the art for a fence seat device that can be stored on a fence when not in use.

The present invention, in one exemplary embodiment, is comprised of a fence seat device preferably comprised of a base with at least one track that attaches to a fence and a seat with at least one leg. In said preferred (first) embodiment, the device is comprised of a base that can be fixedly or removably attached to a fence (wherein the fence is preferably a chain link fence) with at least one fastener located on the base that allows the device to be suspended from the fence during use and while stored such that the device can remain on the fence while not in use and need not to be transported.

The front surface of the base is comprised of a padding that functions as the backrest of the generally chair-like shape formed by the device in the preferred embodiment. The base is further comprised of at least one track. In the preferred embodiment, the base has two parallel tracks on the left and right edges of the base which allow the first arm to move up/down on the track to allow the device to fold/deploy. A first folding arm is preferably attached to the track via at least one hinge point. The first folding arm is then attached to the second folding arm via at least one hinge point. The second folding arm further attaches to the seat via at least one hinge point. The seat attaches to the base via at least one hinge.

The bottom surface of the seat is further comprised of at least one leg assembly comprised of an outer body and at least one inner body positioned within the outer body. The inner body is further comprised of at least one foot that contacts a ground surface. In one embodiment, the inner body is telescopic (and can be locked at a certain length via at least one locking mechanism) such that the length of the leg can be lengthened or shortened as necessary to accommodate the base being secured to a fence at differing heights. During use, the leg contacts the ground and provides additional stability to the seat.

In a second embodiment, the base has no padding (backrest). The second arm also attaches to a secondary anchor point. The anchor point is comprised of at least one fastener that further secures the device to a fence (preferably a chain link fence) during use. In contrast to the first embodiment, the second embodiment allows a user to look through a fence instead of looking away from a fence and does not form a generally chair-like structure.

Accordingly, the fence seat device of the present invention is particularly advantageous as it provides an improved seating device that can be secured to a fence and can remain secured, such that a user need not bring their own chair to a sporting event. Further, the device can be stored on a fence when not in use. In this manner, the fence seat device overcomes the limitations of existing methods of seating at sporting events known in the art.

Referring initially to the drawings, FIG. 1 illustrates a perspective view of a first potential embodiment of a fence seat device 100 of the present invention while attached to a fence 10 and deployed in accordance with the disclosed architecture. In the preferred embodiment, the device 100 is comprised of a base 110 with at least one track 130 that attaches to a fence 10 and a seat 170 with at least one leg 180. In the preferred embodiment, all components of the device are preferably manufactured from a durable metal such as, but not limited to, stainless steel, aluminum or a rigid plastic material such as, but not limited to, acrylic, polycarbonate, polyethylene, thermoplastic, acrylonitrile butadiene styrene, low-density polyethylene, medium-density polyethylene, high-density polyethylene, polyethylene terephthalate, polyvinyl chloride, polystyrene, polylactic acid, acetal, nylon, fiberglass, recycled plastic, biodegradable plastic, etc.

In the preferred (first) embodiment, the device 100 is comprised of a base 110. The base 110 is fixedly or removably attached to a fence 10 (wherein the fence 10 is preferably a chain link fence) with at least one fastener 112 located on the base 110. In differing embodiments, the fastener 112 may be any fastener type known in the art such as, but not limited to, a hook, a loop, a strap, a locking fastener, a magnet, a clip, a groove, a clasp, a tie, etc. The fastener 112 allows the device 100 to be suspended from the fence 10 during use and while stored, such that the device 100 can remain on the fence 10 while not in use and need not to be transported.

The front surface 120 of the base 110 is comprised of a padding 122 that functions as the backrest of the generally chair-like shape formed by the device 100 in the preferred embodiment. The padding 122 is preferably a foam material such as, but not limited to, polyurethane foam, polyester foam, ethafoam, memory foam, lux foam, rebond foam, latex foam, etc., that is waterproof and/or UV resistant to withstand outdoor weather.

In the preferred embodiment, the base 110 is square or rectangular in shape. However, the base 110 may be any shape in differing embodiments. The base 110 is further comprised of at least one track 130. In the preferred embodiment, the base 110 has two parallel tracks 130 on the left and right edges of the base 110 which allow the first arm 140 to move up/down on the track 130 to allow the device 100 to fold/deploy. A first folding arm 140 is preferably attached to the track 130 via at least one hinge point 160. The first folding arm 140 is then attached to the second folding arm 150 via at least one hinge point 160. The hinge point 160 may be a rivet, a pivot pin, or any hinge or pin type known in the art.

The second folding arm 150 further attaches to the seat 170 via at least one hinge point 160. It should be appreciated that the hinge points 160 allow the arms 140,150 and seat 170 to articulate within a 90-degree range of motion. The second folding arm 150 preferably attaches to the side surface 172 of the seat 170. The top surface 174 and front surface 176 of the seat 170 are preferably made from a foam material such as, but not limited to, polyurethane foam, polyester foam, ethafoam, memory foam, lux foam, rebond foam, latex foam, etc., that is waterproof and/or UV resistant to withstand outdoor weather. The seat 170 may be any shape but is preferably square or rectangular.

The seat 170 attaches to the base 110 via at least one hinge 192. The hinge 192 allows the seat 170 to move within a range of motion 90-degrees relative to the base 110. The hinge 192 may be any hinge type known in the art such as, but not limited to, an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gas-piston hinge, an injection molded hinge, a locking hinge, etc. In the deployed position, the seat 170 is perpendicular to the base 110 to form a generally chair-like structure. The hinge points 160 may further lock to secure the device 100 into this position.

The bottom surface 178 of the seat 170 is further comprised of at least one leg assembly 180. The leg assembly 180 is comprised of an outer body 182 and at least one inner body 184 positioned within the outer body 182. The inner body 184 is further comprised of at least one foot 185 that contacts a ground surface. In one embodiment, the inner body 184 is telescopic (and can be locked at a certain length via at least one locking mechanism 188), such that the length of the leg 180 can be lengthened or shortened as necessary to accommodate the base 110 being secure to a fence 10 at differing heights. The leg 180 contacts the ground and provides additional stability to the seat 170. The leg 180 is preferably attached to the bottom surface 178 via at least one hinge 186 such as, but not limited to, an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gas-piston hinge, an injection molded hinge, a locking hinge, etc. In one embodiment, the leg 180 has a generally U-shaped outer body 182 and has two inner bodies 184, each with at least one foot 185.

Figure 2:
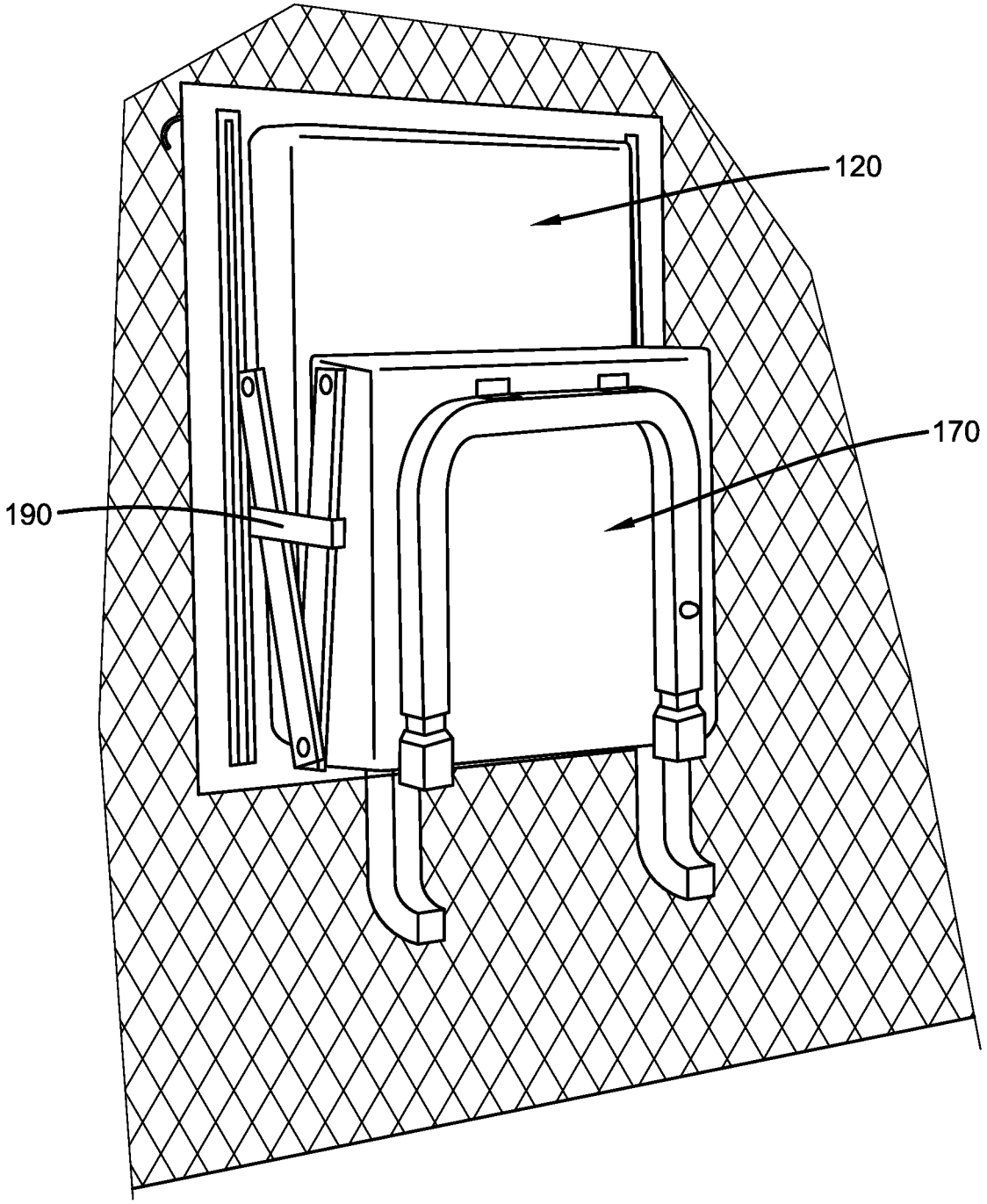
FIG. 2 illustrates a perspective view of a first potential embodiment of a fence seat device of the present invention while attached to a fence and while stored in accordance with the disclosed architecture.

FIG. 2 illustrates a perspective view of a first potential embodiment of a fence seat device 100 of the present invention while attached to a fence 10 and while stored in accordance with the disclosed architecture. The device 100 can be secured in a folded position via at least one lock 190. The lock 190 may be any lock type known in the art such as, but not limited to, a clasp, a locking bar, a latch, a magnet, etc. To use the device 100, a user folds down the seat 170, folds down the legs 180, and then sits on the seat 170 and against the base 110.

Figure 3:
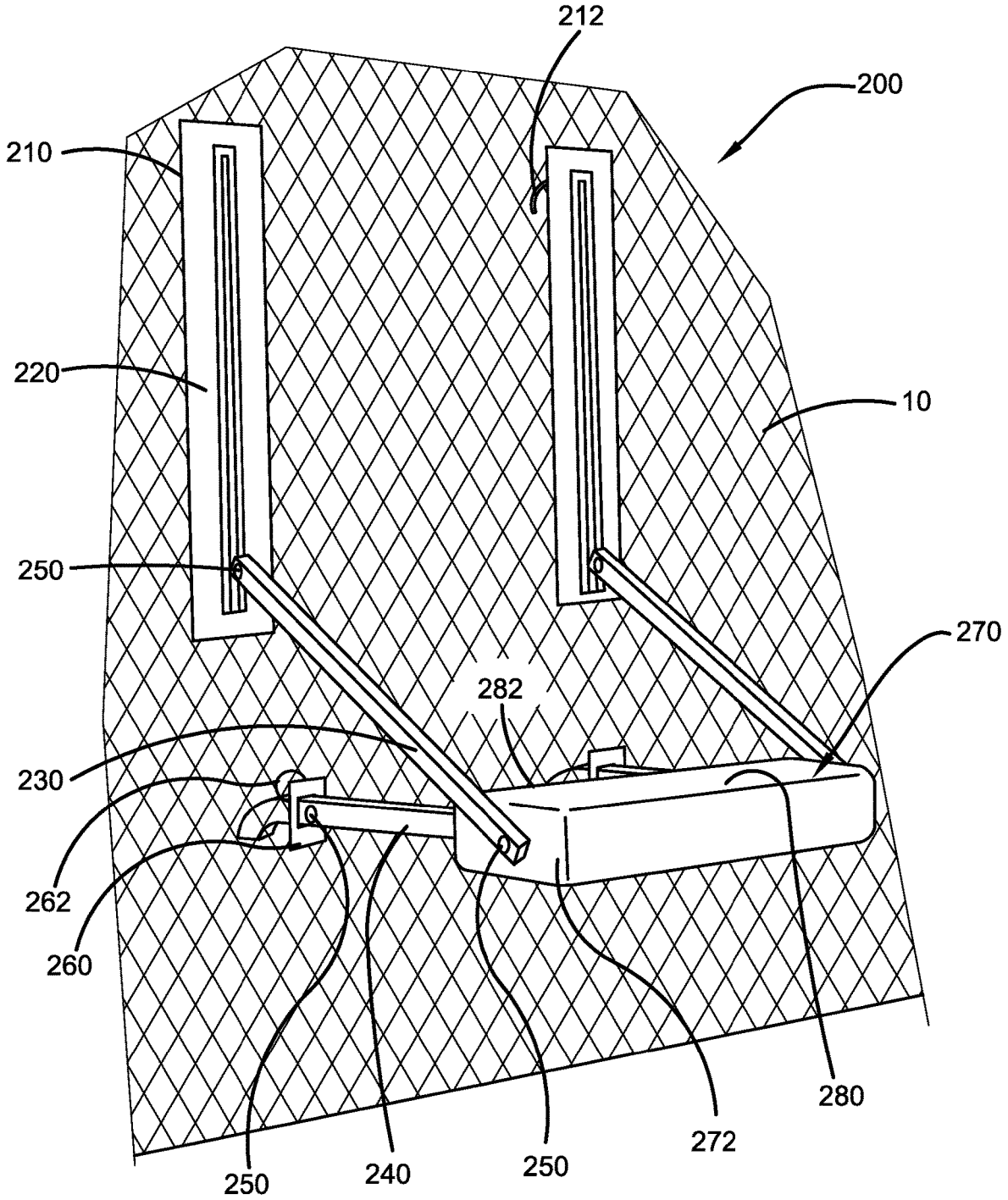
FIG. 3 illustrates a perspective view of a second potential embodiment of a fence seat device of the present invention while attached to a fence and deployed in accordance with the disclosed architecture.

FIG. 3 illustrates a perspective view of a second potential embodiment of a fence seat device 100 of the present invention while attached to a fence 10 and deployed in accordance with the disclosed architecture. The device 100 may also have a second embodiment 200 of differing construction. The second embodiment 200 is comprised of at least one, but preferably two base members 210. In the preferred embodiment, the base members 210 are parallel and are fixedly or removably attached to a fence 10 (wherein the fence 10 is preferably a chain link fence) with at least one fastener 212 located on the base 110. In differing embodiments, the fastener 212 may be any fastener type known in the art such as, but not limited to, a hook, a loop, a strap, a locking fastener, a magnet, a clip, a groove, a clasp, a tie, etc. The fastener 212 allows the device 100 to be suspended from the fence 10 during use and while stored.

In the preferred embodiment, the base 210 is square or rectangular in shape. However, the base 210 may be any shape in differing embodiments. The base 210 is further comprised of at least one track 220. In the preferred embodiment, the base 210 has two parallel tracks 220, each positioned on one of each parallel base 210 which allows the first arm 230 to move up/down on the track 220 to allow the device 200 to fold/deploy. A first folding arm 230 is preferably attached to the track 220 via at least one hinge point 250. The first folding arm 230 is then attached to the second folding arm 240 via at least one hinge point 250. The hinge point 250 may be a rivet, a pivot pin, or any hinge or pin type known in the art.

The second folding arm 240 further attaches to the seat 270 via at least one hinge point 250. It should be appreciated that the hinge points 250 allow the arms 230,240 and seat 270 to articulate within a 90-degree range of motion. The second folding arm 240 preferably attaches to the side surface 272 of the seat 270. The top surface 280 and front surface 282 of the seat 270 are preferably made from a foam material such as, but not limited to, polyurethane foam, polyester foam, ethafoam, memory foam, lux foam, rebond foam, latex foam, etc. that is waterproof and/or UV resistant to withstand outdoor weather. The seat 270 may be any shape but is preferably square or rectangular.

Figure 4:
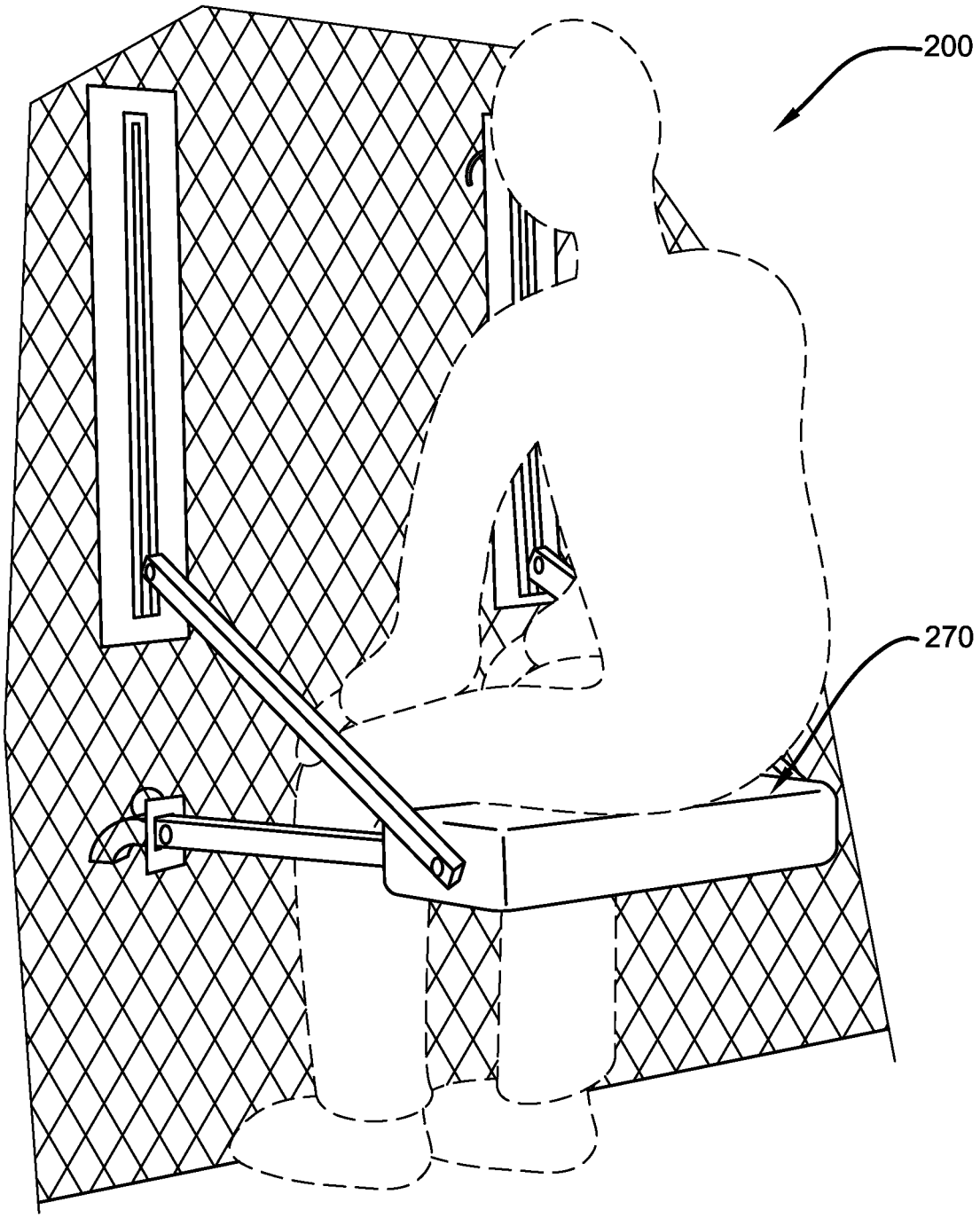
FIG. 4 illustrates a perspective view of a second potential embodiment of a fence seat device of the present invention while attached to a fence and deployed and while a user is sitting on the seat in accordance with the disclosed architecture.

The second arm 240 also attaches to a secondary anchor point 260. The anchor point 260 is comprised of at least one fastener 212 that further secures the device 100 to a fence 10 (preferably a chain link fence) during use. In contrast to the first embodiment, the second embodiment 200 allows a user to look through a fence 10 instead of looking away from a fence 10, as seen in FIG. 4.

Figure 5:
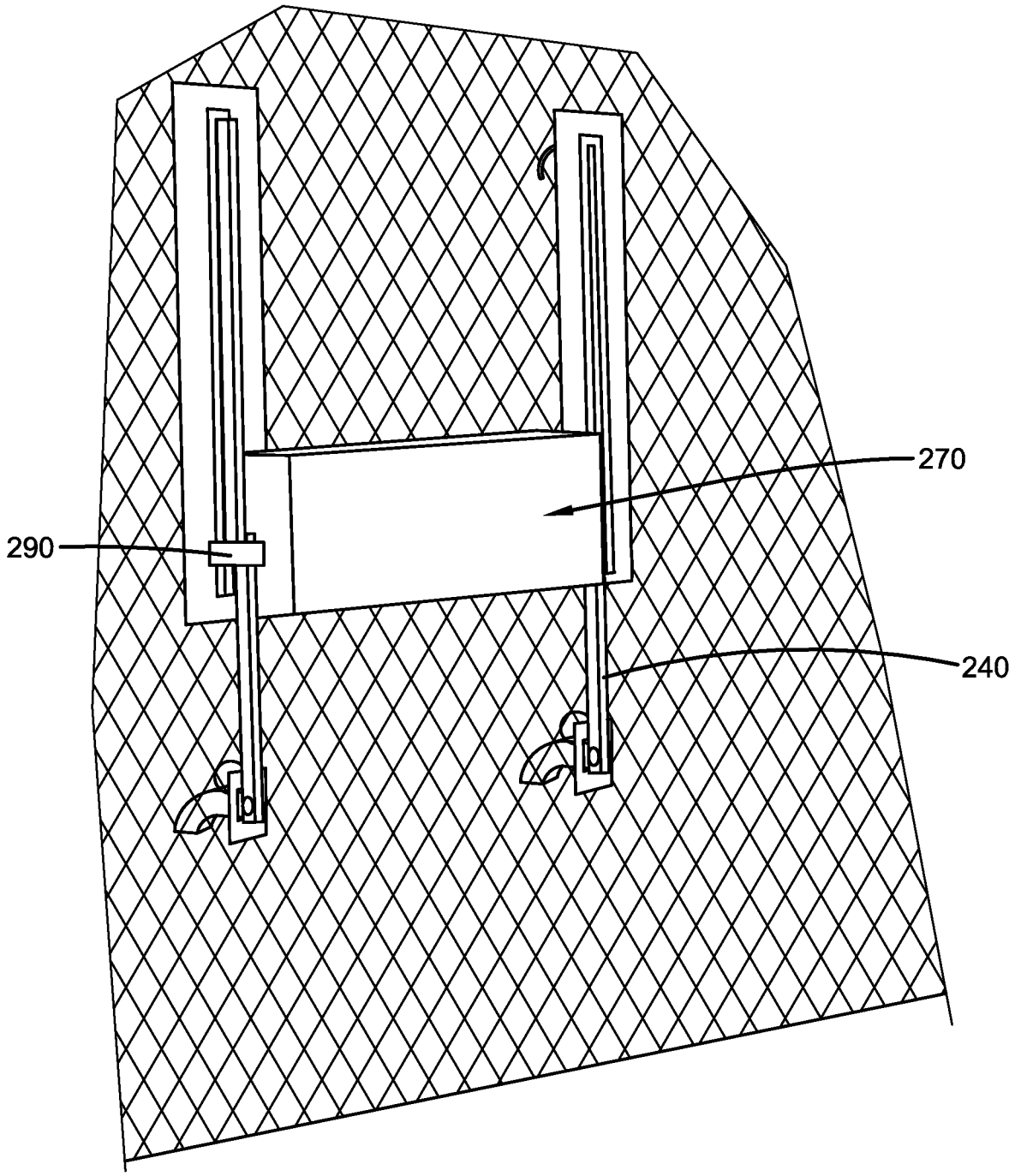
FIG. 5 illustrates a perspective view of a second potential embodiment of a fence seat device of the present invention while attached to a fence and while stored in accordance with the disclosed architecture.

FIG. 5 illustrates a perspective view of a second potential embodiment of a fence seat device 100 of the present invention while attached to a fence 10 and while stored in accordance with the disclosed architecture. The device 200 can be secured in a folded position via at least one lock 290. The lock 290 may be any lock type known in the art such as, but not limited to, a clasp, a locking bar, a latch, a magnet, etc. To use the device 100, a user folds down the seat 270 and then sits on the seat 270 between the seat 270 and the fence 10.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "fence seat device" and "device" are interchangeable and refer to the fence seat device 100,200 of the present invention.

Notwithstanding the foregoing, the fence seat device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the fence seat device 100 as shown in the FIGS. are for illustrative purposes only, and that many other sizes and shapes of the fence seat device 100 are well within the scope of the present disclosure. Although the dimensions of the fence seat device 100 are important design parameters for user convenience, the fence seat device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fence seat device comprising:

a base comprised of a track positioned along an edge of the base, a fastener on the base for securing the base to a fence, and a padding on a front surface of the base;

a first folding arm attached to the track at one end of the first folding arm; a second folding arm connected to an opposing end of the first folding arm via a hinge point:

a seat comprised of a leg extending from a bottom of the seat:

a hinge connecting the seat to the base; and a lock configured to secure the seat to the base in a folded position; and wherein a distal end of the second folding arm attaches to the seat; and wherein the first folding arm is movable within the track.

2. The fence seat device of claim 1, wherein the seat is perpendicular with the base when unfolded.

3. A fence seat device comprising:

a base comprised of a track positioned along an edge of the base, a fastener on the base for securing the base to a fence, and a padding on a front surface of the base;

a first folding arm connected to a second folding arm via a hinge point, wherein the first folding arm attaches to the track;

a seat comprised of a leg, wherein the leg is comprised of an outer body, an inner body and a foot;

a first hinge that connects the base and the seat; and a lock configured to secure the seat to the base in a folded position; and wherein the first folding arm is movable within the track.

4. The fence seat device of claim 3, wherein the leg is telescopic.

5. The fence seat device of claim 4, wherein the leg can be locked into a position via a locking mechanism.

6. The fence seat device of claim 4, wherein the leg is attached to a bottom surface of the seat via a second hinge.

7. The fence seat device of claim 3, wherein the padding is comprised of a polyurethane foam, polyester foam, ethafoam, memory foam, lux foam, rebond foam or a latex foam.

8. The fence seat device of claim 7, wherein the padding is waterproof.

9. A fence seat device comprising:

a base comprised of a track positioned along an edge of the base and a fastener on the base for securing the base to a fence;

a first folding arm connected to a second folding arm via a hinge point, wherein the first folding arm attaches to the track;

an anchor point attached to the second folding arm opposite the hinge point;

a seat hingedly attached to the base; and a lock configured to secure the seat to the base in a folded position; and wherein the first folding arm is movable within the track.

10. The fence seat device of claim 9, wherein the fastener is a hook, a loop, a strap, a locking fastener, a magnet, a clip, a groove, a clasp, or a tie.

11. The fence seat device of claim 9, wherein the seat is comprised of a UV-resistant material.

12. The fence seat device of claim 9, wherein the lock is a clasp.

13. The fence seat device of claim 9, wherein the hinge point is a rivet or a pivot pin.

* * * * *